United States Patent [19]

Krogsrud

[11] 3,975,575

[45] Aug. 17, 1976

[54] ROTATABLE FURNACE POT FOR SMELTING FURNACES

[75] Inventor: Harald Krogsrud, Gjettum, Norway

[73] Assignee: Elkem-Spigerverket A/S, Oslo, Norway

[22] Filed: Apr. 23, 1975

[21] Appl. No.: 570,799

[30] Foreign Application Priority Data

Apr. 25, 1974 Norway ..... 1500/74

[52] U.S. Cl. ..... 13/10

[51] Int. Cl.[2] ..... F27D 3/00

[58] Field of Search ..... 13/10, 9

[56] References Cited

UNITED STATES PATENTS 2,744,944 5/1956 Striplin, Jr. et al. ..... 13/10

FOREIGN PATENTS OR APPLICATIONS 106,787 7/1927 Austria ..... 13/10

*Primary Examiner*—R. N. Envall, Jr.

*Attorney, Agent, or Firm*—Eyre, Mann, Lucas & Just

[57] ABSTRACT

An improved rotatable furnace pot for smelting furnaces is disclosed. The furnace pot is segmented into upper and lower sections rotatable with respect to each other whereby substantial advantage is obtained as compared to unitary rotatable smelting pots.

12 Claims, 1 Drawing Figure

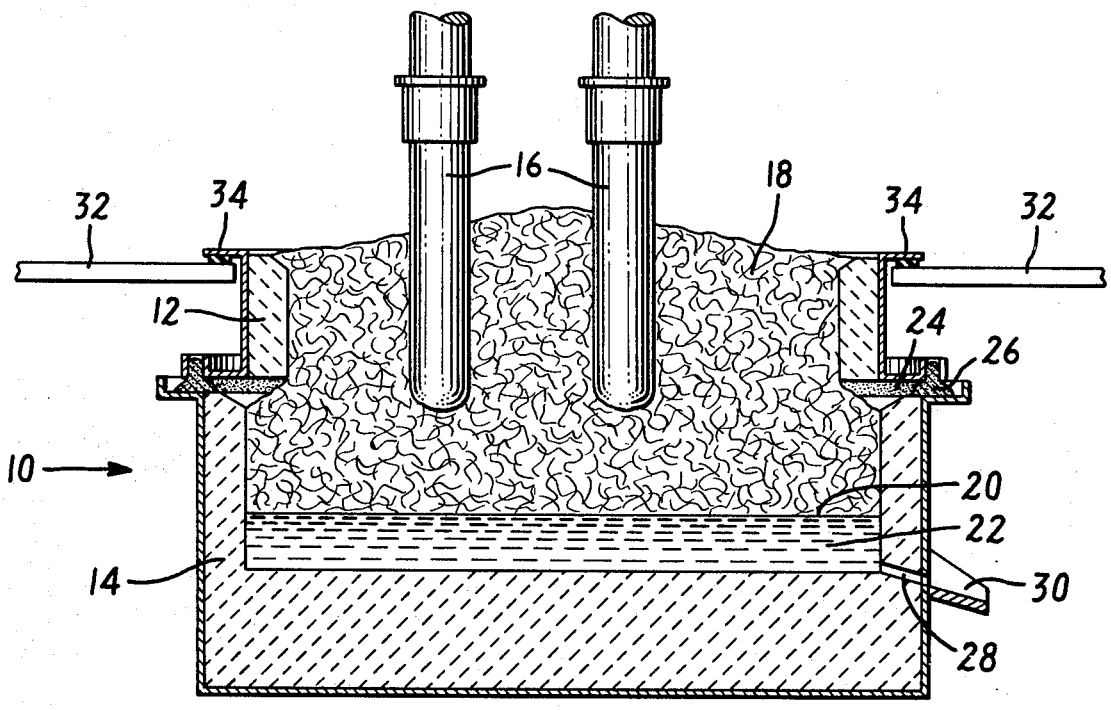
16
18
32
34
34
32
12
24
26
10
20
22
14
30
28

ROTATABLE FURNACE POT FOR SMELTING FURNACES

The present application is related to my co-pending application Ser. No. 570,800 filed on even date herewith.

The present invention relates to electric smelting furnaces and more particularly to electric smelting furnaces which are equipped with a rotatable furnace pot. It is well known in the production of carbides, ferro alloys, silicon metal and silicon metal alloys and the like in an electric smelting process that it is desirable to cause movement of the charge in the smelting furnace. This will help in reduction of formation of crusts and hangings in the furnace and will also result in a more even heat distribution throughout the charge in the furnace pot. One method of achieving movement of the charge is by mechanical stoking. The need for mechanical stoking can be reduced by having a rotatable furnace pot since the rotating furnace pot will reduce the crusts and bridges formed between the electrodes and will also move the peripheral parts of the charge into the smelting zone which surrounds each electrode.

A disadvantage encountered with the rotation of smelting furnace pots is occasioned by the high layer of charge, on the order of 2–3 meters, which exists in the furnace pot. In order to prevent breaking of or damage to the electrodes by the force of the rotating charge, it is necessary that the speed of rotation be kept very low. For example, in the production of a ferro silicon alloy of 75% ferrous material, the speed of rotation must be on the order of 100 hours for a single revolution in order to prevent damage to the electrodes.

As is known, the metal from the smelting pot is removed through tap holes in the smelting pot by means of tapping equipment including spouts and the like associated therewith. The very slow rotation of the smelting pot complicates the tapping arrangement since it is necessary to have a number of tapping spouts and an annular track around the smelting furnace for movement of the tapping wagons and the tapping equipment into position at the appropriate time for tapping. In addition to the high economics of such an arrangement and the inconvenience thereof including space requirements and maintenance, there is also substantial chance of damage to the annular track by splashings and spillings which occur during the tapping procedure.

In accordance with the present invention, these disadvantages are overcome by segmenting the smelting pot which permits relative rotation of the bottom segment and the top segment of the smelting pot. The bottom segment can then travel at a higher speed (or remain stationary) so that the tapping spouts can be maintained in stationary position and the tapping holes can be brought into juxtaposition therewith at the appropriate time for tapping.

These and other features of the present invention may be more fully understood with reference to the drawing.

In the drawing there is shown an electric smelting pot 10 segmented into upper and lower portions 12 and 14 respectively. Electrodes 16, arranged in triangular shape in known manner, are situated in the pot and surrounded by the charge 18.

If the rotatable pot were a unitary structure, rotation of the pot would cause rotation of the total charge in a single direction. Because of the weight and cohesiveness of the charge, rotation would have to be very slow in order to prevent damage to the electrodes 16 by movement of the charge 18. In accordance with the present invention, and as shown, the furnace pot is divided into upper and lower segments 12 and 14 respectively. When the lower segment 14 is rotated (means known and not shown) and the upper segment 12 is maintained stationary, the speed of rotation of the lower segment 14 can be made considerably higher (as high as one revolution in 5 hours) since the rotative effect on the charge will not be as great and the forces applied to the electrodes by the charge will be correspondingly reduced. It will be appreciated that this advantage can be obtained even if the upper segment 12 is also rotated, provided the upper segment is rotated at a lower speed or is rotated in couter-current direction to the direction of rotation of the lower segment 14.

The relative height of the upper and lower portions of the furnace pot is not critical, but each segment must be at least 25% of the total height of the furnace pot. Thus, if the lower segment is 60% of the height of the furnace pot then the upper segment would be 40%. In addition, it is necessary that the height of the lower segment 14 would be higher than the level 20 of the metal 22 so that there is no escape of metal in the parting line 24 between the upper and lower segments. In order to maintain good heating qualities in the furnace pot, a gastight seal should be employed between the upper and lower segments. This gastight seal can suitably be sand 26 or other granulated material since such materials will withstand the heat of the furnace while at the same time permitting relative rotation of the upper and lower segments and still maintaining a gastight seal.

Since the lower segment 14 of the smelting pot can be rotated at a higher rate of speed, the tapping hole 28 can be brought into register with the tapping spout 30 at the appropriate time for slag removal without the need for the spout being movable on an annular track or the like. This is facilitated by the fact that the segmented pot permits the lower segment to be reversed in direction (a feature not practical with unitary smelting pots) to bring the tapping hole 28 into register with the tapping spout 30.

As shown in the FIGURE, the upper segment 12 of the smelting pot 10 rests on arms 32 by means of projections 34. The advantage to this arrangement is that the upper segment can be of smaller radial dimension than the lower segment which results in a greater concentration of heat in the upper portion and better utilization of the heat content of the reaction gases. It is also to be understood that while the lower segment should be annular, the upper segment can be triangular, of cloverleaf shape or the like which reduces the dead zones between the electrodes and the circumferential portion of the furnace pot. It has also been found advantageous in the reduction of dead zones to arrange the upper and lower segments of the furnace pot so that their axes of rotation do not coincide but are spaced with respect to each other.

A still further advantage of the present invention is that it is adaptable to covered furnaces as well as open furnaces. It is normally considered that rotatable smelting pots can only be used in open smelting furnaces. However, with the apparatus of the instant invention, since the upper and lower segments of the smelting pot are individually rotatable with respect to each other, the smelting pot can be used in covered or semi-covered furnaces.

It will be understood that the claims are intended to cover all changes and modifications of the preferred embodiment of the invention, herein chosen for the purpose of illustration, which do not constitute departures from the spirit and scope of the invention.

What is claimed is:

1. In an electric smelting furnace, a furnace pot, said furnace pot being divided into upper and lower wall segments each of which comprises at least 25% of the height of the furnace pot, said wall segments of the furnace pot being rotatable with respect to each other.

2. The apparatus of claim 1 further including a gastight seal between the upper and lower wall segments.

3. The apparatus of claim 1 wherein the lower wall segment is rotatable and the upper wall segment is stationary.

4. The apparatus of claim 1 wherein the radial dimension of the upper wall segment is less than the radial dimension of the lower wall segment.

5. In an electric smelting furnace, a furnace pot, said furnace pot being divided into upper and lower wall segments each of which comprises at least 25% of the height of the furnace pot and each of which is operative to enclose charge therein, said wall segments of the furnace pot being operative to be rotated with respect to each other to impart non-uniform motion to at least some of the charge in said segments.

6. The apparatus of claim 5 further including a gastight seal between the upper and lower wall segments.

7. The apparatus of claim 5, wherein the lower wall segment is rotatable and the upper wall segment is stationary.

8. The apparatus of claim 5, wherein the radial dimension of the upper wall segment is less than the radial dimension of the lower wall segment.

9. In an electric smelting furnace having at least one vertically disposed electrode, a furnace pot, said furnace pot being divided into upper and lower wall segments each of which comprises at least 25% of the height of the furnace pot and each of which is operative to enclose charge therein, said wall segments of the furnace pot being operative to be rotated with respect to each other to impart non-uniform motion to at least some of the charge in said segments, said at least one electrode extending into said furnace pot.

10. The apparatus of claim 9 further including a gastight seal between the upper and lower wall segments.

11. The apparatus of claim 9, wherein the lower wall segment is rotatable and the upper wall segment is stationary.

12. The apparatus of claim 9, wherein the radial dimension of the upper wall segment is less than the radial dimension of the lower wall segment.

* * * * *